US008536933B2

(12) United States Patent
Santo et al.

(10) Patent No.: US 8,536,933 B2
(45) Date of Patent: Sep. 17, 2013

(54) METHOD AND CIRCUIT FOR AN OPERATING AREA LIMITER

(75) Inventors: Hendrik Santo, San Jose, CA (US); Dilip Sangam, Saratoga, CA (US); Kien Vi, Palo Alto, CA (US); Ranajit Ghoman, Santa Clara, CA (US); Matthew D. Schindler, Redwood City, CA (US)

(73) Assignee: ATMEL Corporation, San Jose, CA (US)

( * ) Notice: Subject to any disclaimer, the term of this patent is extended or adjusted under 35 U.S.C. 154(b) by 0 days.

(21) Appl. No.: 13/426,322

(22) Filed: Mar. 21, 2012

(65) Prior Publication Data

US 2012/0176184 A1 Jul. 12, 2012

Related U.S. Application Data

(63) Continuation of application No. 12/045,588, filed on Mar. 10, 2008.

(51) Int. Cl.
*G05F 1/10* (2006.01)
*G05F 3/02* (2006.01)

(52) U.S. Cl.
USPC ..... 327/538; 327/540

(58) Field of Classification Search
USPC ..... 327/538, 540, 541, 427, 434–437
See application file for complete search history.

(56) References Cited

U.S. PATENT DOCUMENTS

| | | | | |
|---|---|---|---|---|
| 5,361,007 | A | 11/1994 | Ohta | |
| 5,825,321 | A | 10/1998 | Park | |
| 6,031,749 | A | 2/2000 | Covington et al. | |
| 6,552,586 | B2 | 4/2003 | Grasset et al. | |
| 6,798,629 | B1 | 9/2004 | Proebsting | |
| 7,595,620 | B2 | 9/2009 | Sakai et al. | |
| 7,723,970 | B1 * | 5/2010 | Fernald | 323/282 |
| 2006/0208669 | A1 | 9/2006 | Huynh | |
| 2006/0214650 | A1 | 9/2006 | Hirooka | |

OTHER PUBLICATIONS

International Search Report and Written Opinion of PCT Application No. PCT/US2009/035330 dated Apr. 27, 2009, 10 pages.
Office Action issued in U.S. Appl. No. 12/045,588 mailed Jan. 18, 2012, 7 pages.
Final Office Action issued in U.S. Appl. No. 12/045,588 mailed May 17, 2012, 9 pages.

* cited by examiner

*Primary Examiner* — Lincoln Donovan
*Assistant Examiner* — Diana J Cheng
(74) *Attorney, Agent, or Firm* — Fish & Richardson P.C.

(57) ABSTRACT

The present invention relates to circuits and methods for limiting the operating area of a transistor in a constant current source. The circuits and methods use a detector and a driver to limit the operating area of a transistor. The detector and driver have parameters selected so that, when the voltage at the drain of the transistor satisfies a reference condition, the driver causes drain current of the transistor to decrease. The reference condition is determined relative to the maximum safe drain-to-source voltage at the design drain current of the constant current source.

23 Claims, 12 Drawing Sheets

METHOD AND CIRCUIT FOR AN OPERATING AREA LIMITER

CROSS-REFERENCE TO RELATED APPLICATIONS

This application is a continuation of U.S. patent application Ser. No. 12/045,588, filed Mar. 10, 2008 entitled "Method and Circuit for an Operating Area Limiter", the contents of which are incorporated herein by reference in its entirety.

FIELD OF INVENTION

The present invention relates to constant current sources, and more particularly, to controlling the operating area of a transistor used in constant current sources such as those used in light emitting diode ("LED") strings for backlighting electronic displays.

BACKGROUND OF THE INVENTION

Backlights are used to illuminate liquid crystal displays ("LCDs"). LCDs with backlights are used in small displays for cell phones and personal digital assistants ("PDAs") as well as in large displays for computer monitors and televisions. Often, the light source for the backlight includes one or more cold cathode fluorescent lamps ("CCFLs"). The light source for the backlight can also be an incandescent light bulb, an electroluminescent panel ("ELP"), or one or more hot cathode fluorescent lamps ("HCFLs").

The display industry is enthusiastically pursuing the use of LEDs as the light source in the backlight technology because CCFLs have many shortcomings: they do not easily ignite in cold temperatures, they require adequate idle time to ignite, and they require delicate handling. Moreover, LEDs generally have a higher ratio of light generated to power consumed than the other backlight sources. Because of this, displays with LED backlights can consume less power than other displays. LED backlighting has traditionally been used in small, inexpensive LCD panels. However, LED backlighting is becoming more common in large displays such as those used for computers and televisions. In large displays, multiple LEDs are required to provide adequate backlight for the LCD display.

Circuits for driving multiple LEDs in large displays are typically arranged with LEDs distributed in multiple strings. FIG. 1 shows an exemplary flat panel display 10 with a backlighting system having three independent strings of LEDs 1, 2 and 3. The first string of LEDs 1 includes seven LEDs 4, 5, 6, 7, 8, 9 and 11 discretely scattered across the display 10 and connected in series. The first string 1 is controlled by the drive circuit 12. The second string 2 is controlled by the drive circuit 13 and the third string 3 is controlled by the drive circuit 14. The LEDs of the LED strings 1, 2 and 3 can be connected in series by wires, traces or other connecting elements.

FIG. 2 shows another exemplary flat panel display 20 with a backlighting system having three independent strings of LEDs 21, 22 and 23. In this embodiment, the strings 21, 22 and 23 are arranged in a vertical fashion. The three strings 21, 22 and 23 are parallel to each other. The first string 21 includes seven LEDs 24, 25, 26, 27, 28, 29 and 31 connected in series, and is controlled by the drive circuit, or driver, 32. The second string 22 is controlled by the drive circuit 33 and the third string 23 is controlled by the drive circuit 34. One of ordinary skill in the art will appreciate that the LED strings can also be arranged in a horizontal fashion or in another configuration.

An important feature for displays is the ability to control the brightness. In LCDs, the brightness is controlled by changing the intensity of the backlight. The intensity of an LED, or luminosity, is a function of the current flowing through the LED. FIG. 3 shows a representative plot of luminous intensity as a function of forward current for an LED. As the current in the LED increases, the intensity of the light produced by the LED increases.

To generate a stable current, circuits for driving LEDs use constant current sources. FIG. 4 is a representation of a circuit used to generate a constant current. A constant current source is a source that maintains current at a constant level irrespective of changes in the drive voltage $V_{SET}$. Constant current sources are used in a wide variety of applications; the description of applications of constant current sources as used in LED arrays is only illustrative. The operational amplifier 40 of FIG. 4 has a non-inverting input 41, an inverting input 42, and an output 43. To create a constant current source, the output of the amplifier 40 may be connected to the gate of a transistor 44. The transistor 44 is shown in FIG. 4 as a field effect transistors ("FET"), but other types of transistors may be used as well. Examples of transistors include IGBTs, nMOS devices, JFETs and bipolar devices. The drain of the transistor is connected to the load 45, which in FIG. 4 is an array of LEDs. The inverting input of the amplifier 40 is connected to the source of the transistor 44. The source of the transistor 44 is also connected to ground through a sensing resistor $R_S$ 46. When a reference voltage, is applied to the non-inverting input of the amplifier 40, the amplifier increases the output voltage until the voltage at the inverting input matches the voltage at the non-inverting input. As the voltage at the output of the amplifier 40 increases, the voltage at the gate of the transistor 44 increases. As the voltage at the gate of the transistor 44 increases, the current from the drain to the source of the transistor 44 increases.

For an LED backlit display to operate at a given brightness, the current in the drain current of the transistor 44 must be maintained at a set level: the design current. The design current may be a fixed value or it may change depending upon the brightness settings of the display.

FIG. 5 illustrates a typical relationship between the drain current and the gate voltage for an exemplary transistor. Since little to no current flows into the inverting input of the amplifier 40, the increased current passes through the sensing resistor $R_S$. As the current across the sensing resistor $R_S$ increases, the voltage drop across the sensing resistor also increases according to Ohm's law: voltage drop (V)=current (i)*resistance (R). This process continues until the voltage at the inverting input of the amplifier 40 equals the voltage at the non-inverting input. If, however, the voltage at the inverting input is higher than that at the non-inverting input, the voltage at the output of the amplifier 40 decreases. That in turn decreases the source voltage of the transistor 44 and hence decreases the current that passes from the drain to the source of the transistor 44. Therefore, the circuit of FIG. 4 keeps the voltage at the inverting input and the source side of the transistor 44 equal to the voltage applied to the non-inverting input of the amplifier 40 irrespective of changes in the drive voltage $V_{SET}$.

Large displays with LED backlights use multiple constant current sources like that of FIG. 4. Therefore, large LED-backlit displays use many transistors 44. Transistors are limited in the maximum drain-to-source voltage and drain current that the transistor can safely handle. Curves that show a transistor's limitations of simultaneous high voltage and high current, up to the rating of the device, are often provided to circuit designers by transistor manufacturers. These curves are generally known as safe operating area curves. The safe operating area ("SOA") of the transistor is the area below the curve. An example of an SOA curve is shown in FIG. 6.

FIG. 6 illustrates a SOA curves for two different operating conditions: continuous current mode 60 and discontinuous pulse current mode 61. Multiple SOA curves for discontinuous pulse current modes 61 based upon the relative pulse duration are generally provided by the transistor manufacturer. For a given forward drain current, the SOA curve instructs circuit designers on the maximum drain-to-source voltage that the transistor can safely handle. For example, at the continuous drain current 62 in FIG. 6, the maximum safe drain-to source voltage 63 for the transistor is determined from the SOA curve. If the maximum safe drain-to-source voltage 63 is exceeded at the drain current 62 shown, the transistor is at risk of failure or degradation. Therefore, circuit designers must ensure the operation of the transistor is within its SOA.

To expand the area under the SOA curve for higher maximum drain current ratings, the size of the transistor must be increased. Larger transistors are more expensive and require a larger die size if integrated into a single die or integrated circuit. To extend the area under the SOA curve for higher maximum drain-to-source voltages, an enhanced or more complex fabrication process must be used. Transistors fabricated for larger drain-to-source voltages might not be readily available or cost effective for many designs. To reduce device size and costs, circuit designers often choose the basic minimum-geometry transistor that can safely operate at the design drain-to-source voltage and design drain current. However, this often limits the available overhead room for increased drain-to-source voltage at the design drain current.

Occasionally, the drain-to-source voltage of the transistor 44 may unexpectedly increase above the design level. This may happen because of inadvertent over-voltage of the drive voltage $V_{SET}$ or due to shorting of the load 45. Shorting of the load 45 can happen for many reasons including foreign material shorting the load path, improper soldering during assembly of the circuit, and damage in the load. When the drain-to-source voltage increases from the design voltage due to a short, it may increase all the way to the drive voltage $V_{SET}$. When the drain-to-source voltage inadvertently increases at a given drain current, the operating point of the transistor may go beyond the safe operating area. An example of this for a transistor operated in continuous current mode is shown at point 64 in FIG. 6. At point 64, the drain-to-source voltage has increased to the drive voltage $V_{SET}$. The drain current is at the design current 62. Since the operating condition 64 of the transistor is outside of the safe operating area, the transistor has a high probability of immediate failure or degradation. If a transistor fails or degrades, the current source will no longer function properly. Transistor failure or degradation causes safety and reliability problems and therefore increases recall and warranty costs for device manufacturers.

For a circuit that could safely operate at the design current 62 and drain-to-source voltage $V_{SET}$, circuit designers would have to use a much larger transistor with a SOA that encompassed the point defined by the design current 62 and drain-to-source voltage $V_{SET}$. A larger transistor would be more expensive and more difficult to integrate into a device designed to be integrated into a single chip.

SUMMARY OF THE INVENTION

The present invention relates to circuits and methods for limiting the operating area of a transistor in a constant current source circuit. The circuits and methods use a detector and a driver to limit the operating area of a transistor. The detector and driver have parameters selected so that, when the voltage at the drain of the transistor satisfies a reference condition, the driver causes drain current of the transistor to decrease. The reference condition is determined relative to the maximum safe drain-to-source voltage at the design drain current of the constant current source.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

The methods and circuits of the present invention relate to the regulation of the operating area of a transistor. The constant current sources described may be used in LED strings of the backlights of electronic displays or they may be used to drive any electronics load. The methods and circuits of the present invention prevent the degradation and failure of transistors by preventing the drain-to-source voltage and drain current of the transistor from exceeding the safe operating area of the transistor.

Figure 1:
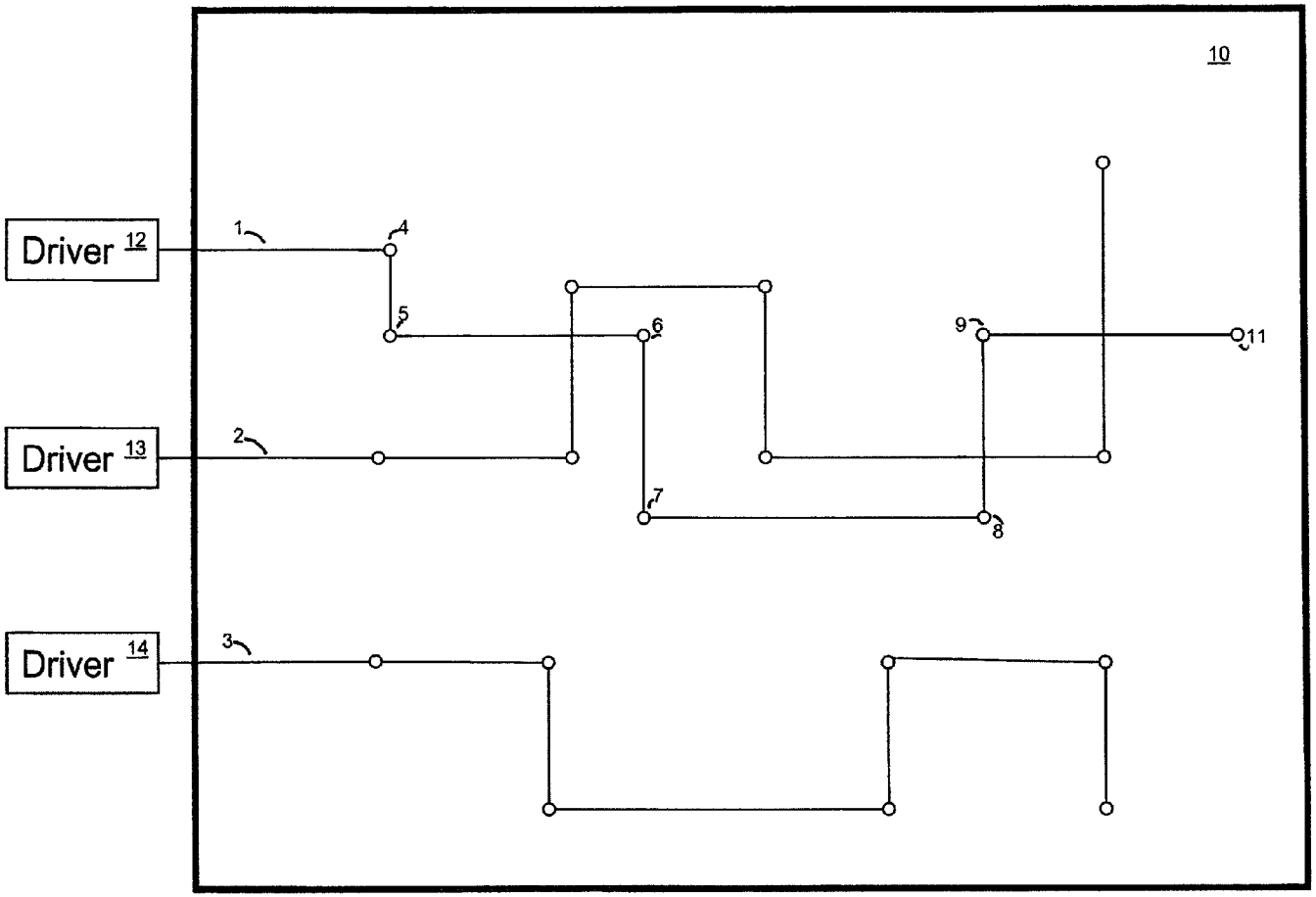
FIG. 1 (Prior Art)
FIG. 1 illustrates an exemplary display implementing LED strings.
Figure 2:
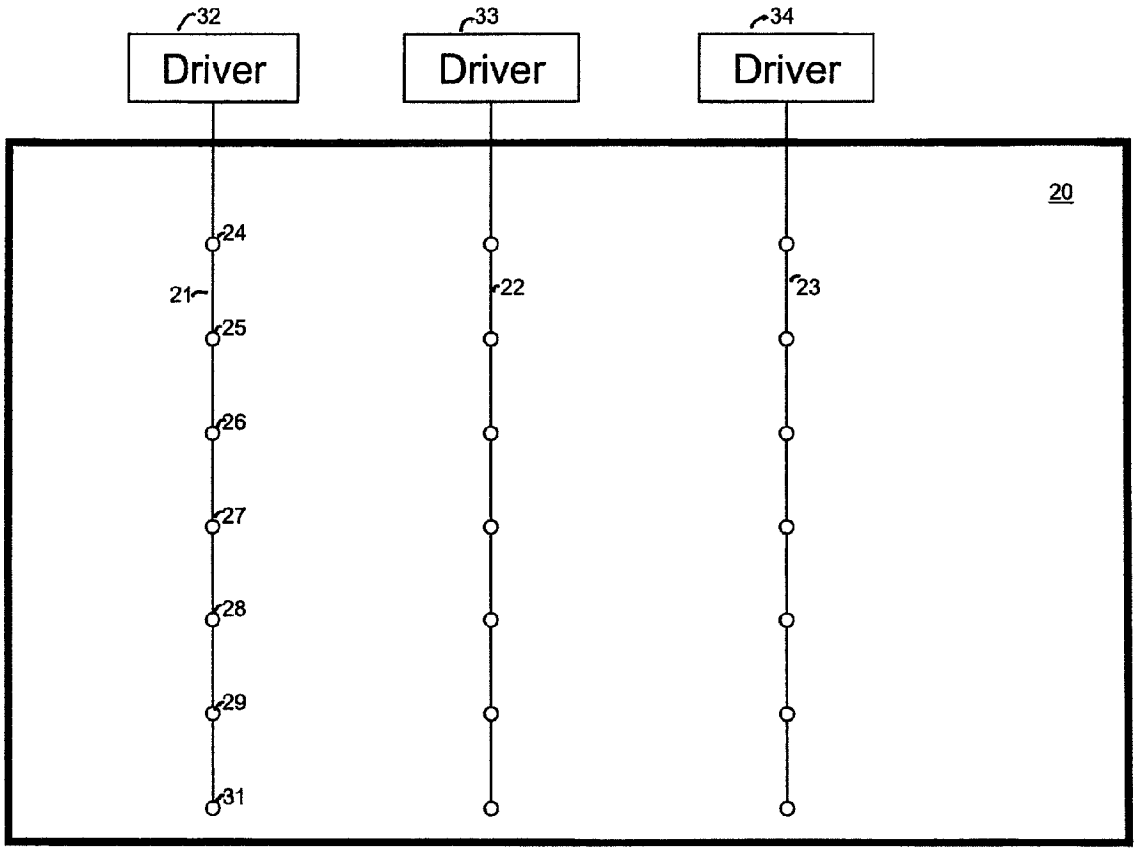
FIG. 2 (Prior Art)
FIG. 2 illustrates another exemplary display implementing LED strings.
Figure 3:
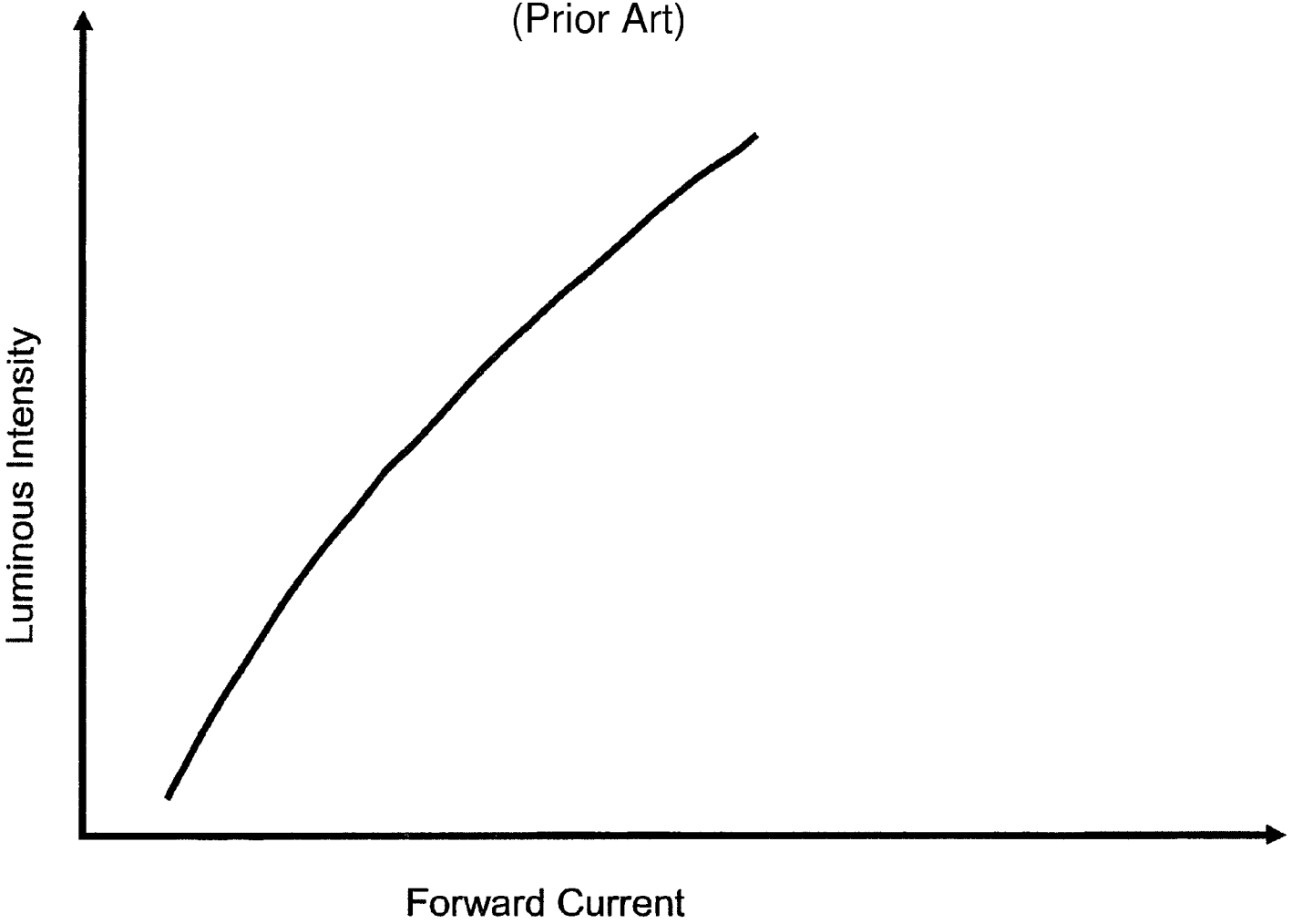
FIG. 3 (Prior Art)
FIG. 3 illustrates a graph showing the relationship between current and luminous intensity in an LED.
Figure 4:
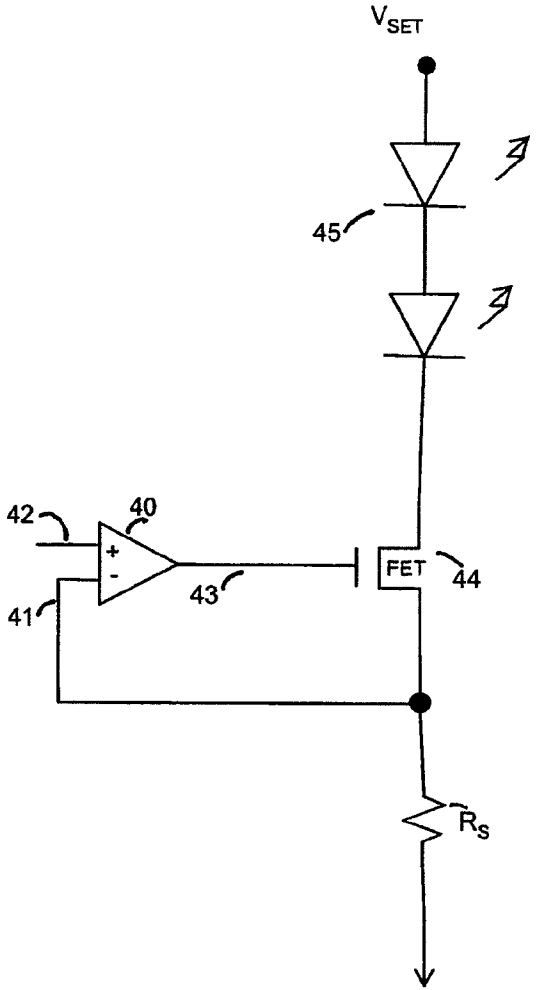
FIG. 4 (Prior Art)
FIG. 4 illustrates a prior art technique for providing constant current source.
Figure 5:
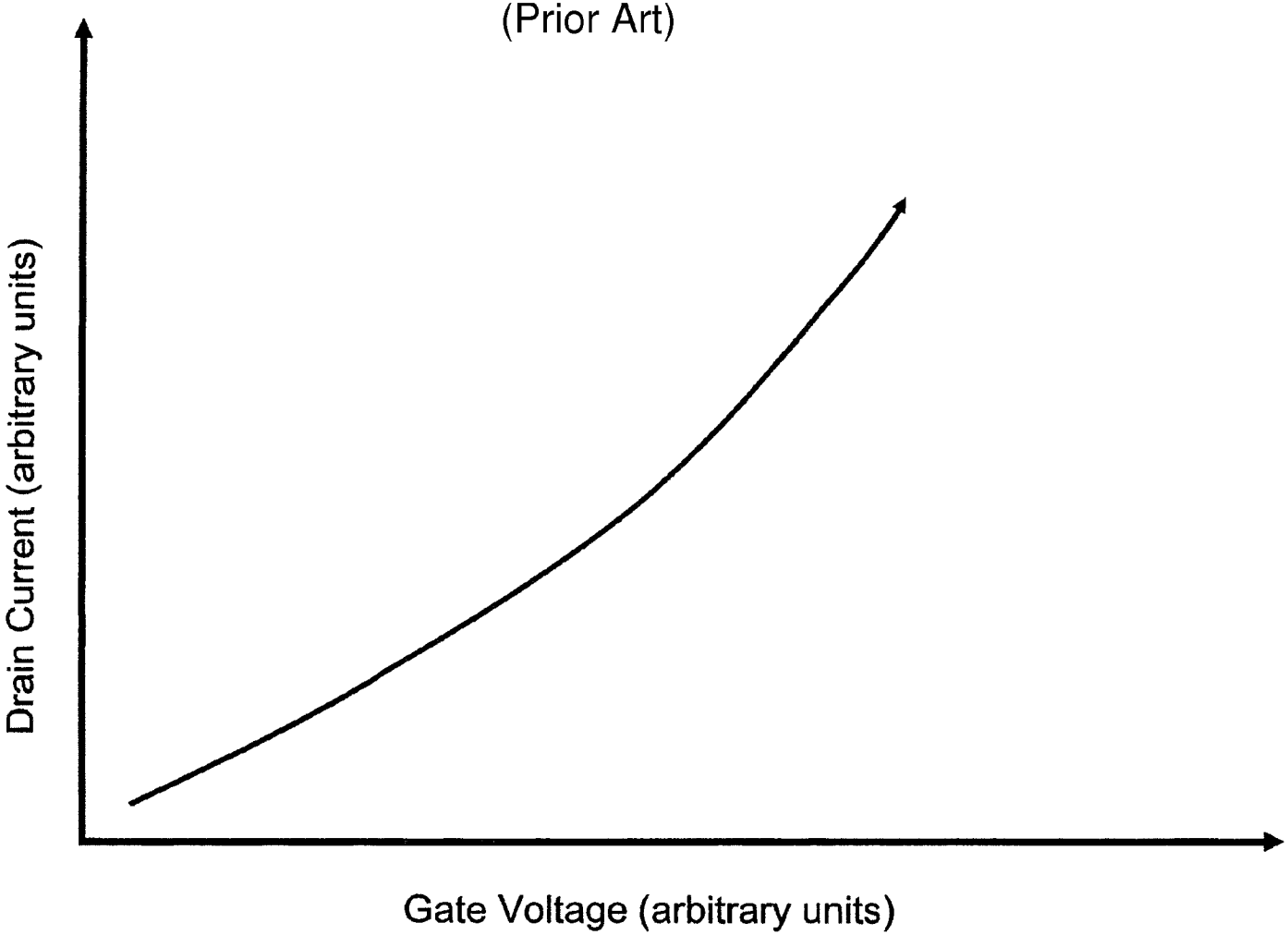
FIG. 5 (Prior Art)
FIG. 5 illustrates a graph showing the relationship between gate voltage and source current in a transistor.
Figure 6:
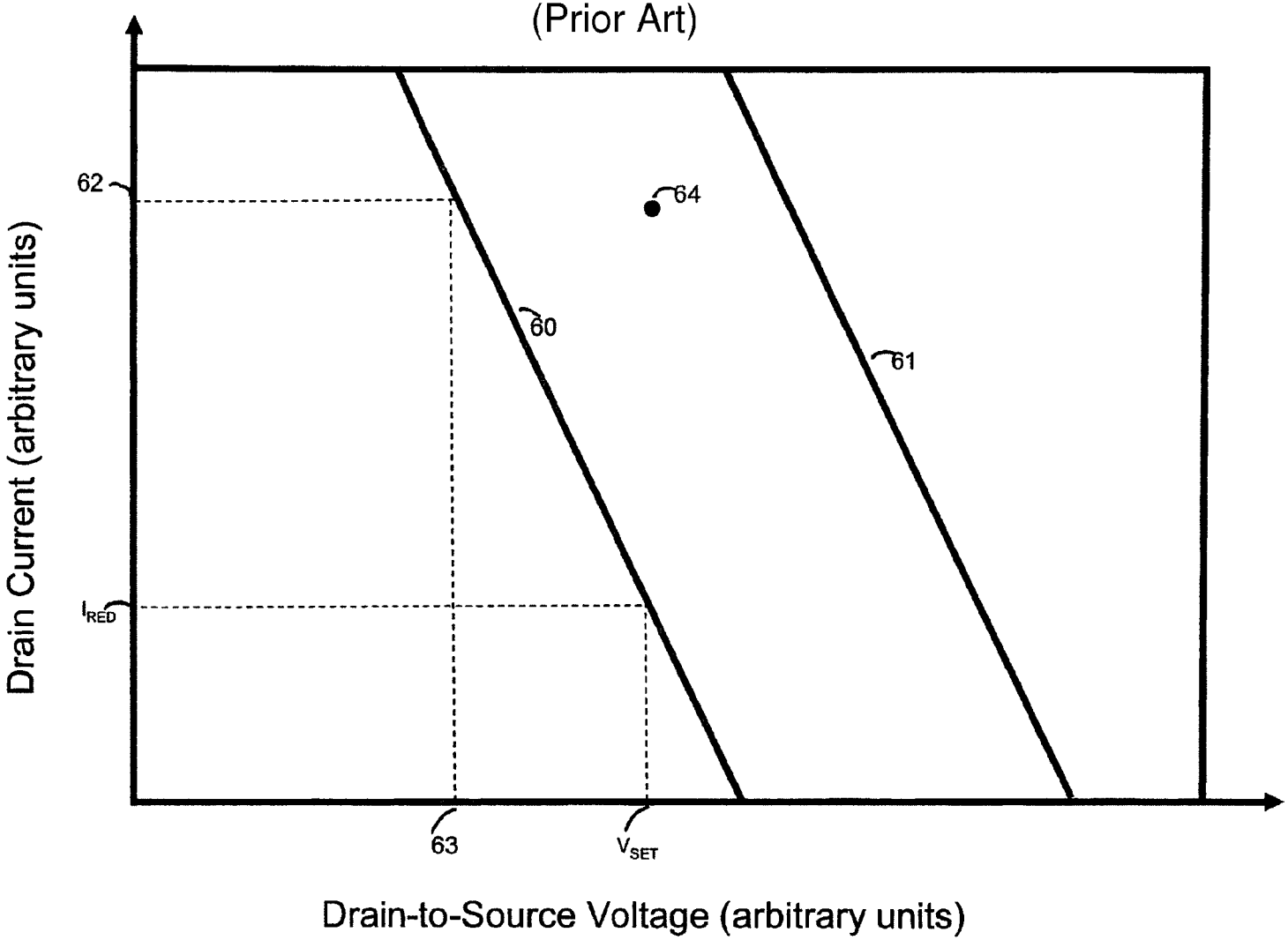
FIG. 6 (Prior Art)
FIG. 6 illustrates a safe operating curve for a transistor in continuous and discontinuous pulse current modes.
Figure 7:
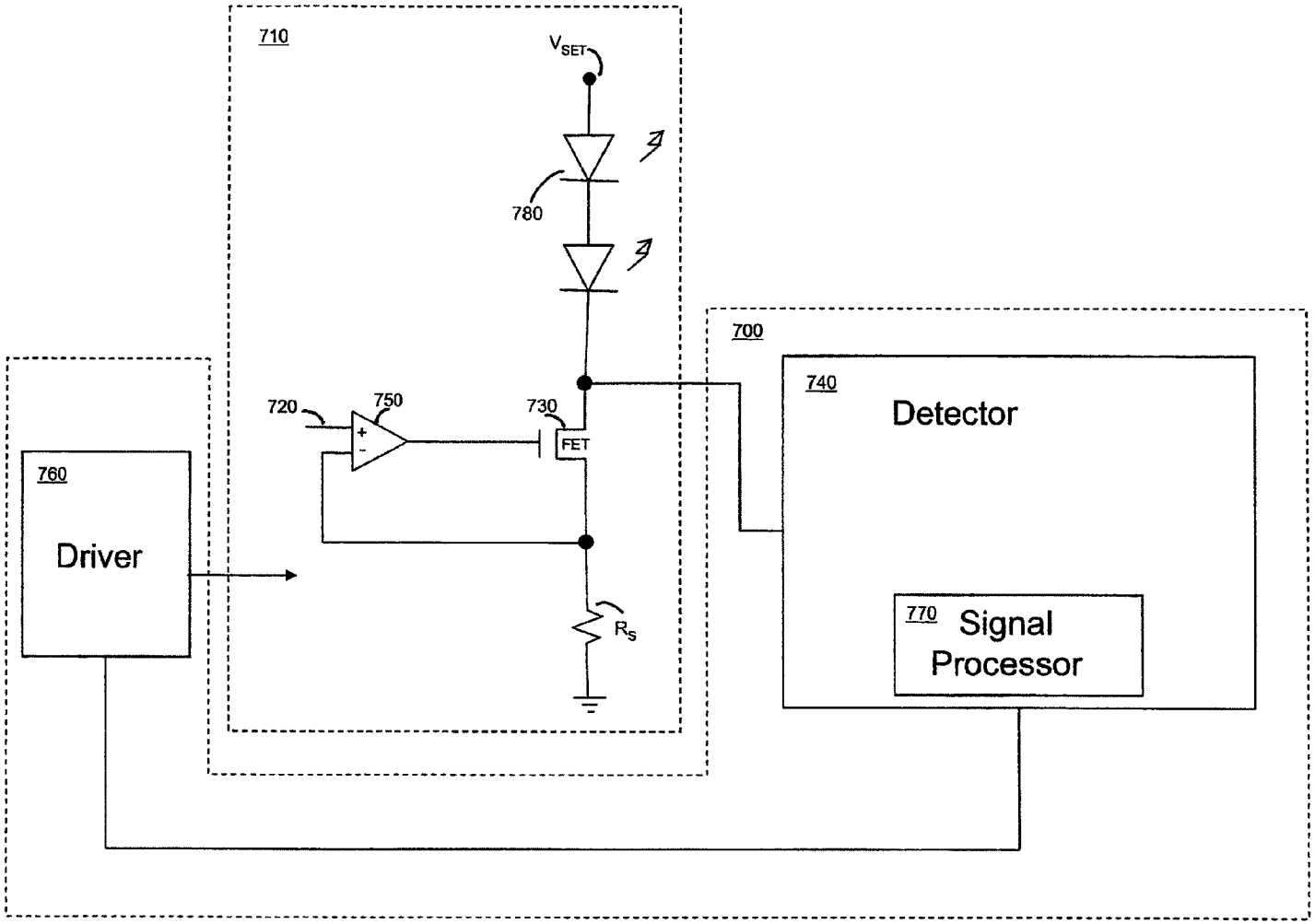
FIG. 7 illustrates an exemplary embodiment of the operating area limiter of the present invention.

FIG. 7 shows an exemplary example of the operating area limiter 700 of the present invention. The exemplary circuit of the present invention 700 limits the operating area of a transistor 730 like the one used in the constant current source 710. The transistor 730 of the constant current source has a drain, a source, and a gate terminal. The operating area limiter circuit 700 uses a detector 740 to detect changes in the voltage at the drain of transistor 730 and a driver 760 to control the drain current of the transistor 730. The drain-to-source voltage of the transistor 730 is a function of the drain voltage because the drain voltage of the transistor 730 equals the drain-to-source voltage minus the drain current times the resistance of the sensing resistor $R_S$.

The connection of the detector 740 to the drain of the transistor 730, as well as other connections described herein may be direct or indirect. Connections may be electronic, electromagnetic, electrooptical, mechanical, or any mixture of the above.

The detector 740 and the driver 760 are designed and configured so that the driver reduces the drain current of the transistor 730 when the drain voltage of the transistor 730 satisfies a reference condition as determined by the detector 740. The reference condition is determined by the maximum safe drain-to-source voltage at the design drain current of the constant current source. The reference condition may be a maximum drain voltage set relative to the maximum safe drain-to-source voltage at the design drain current of the transistor 730. The reference condition may also include durational limits so that the reference condition is not satisfied unless the drain voltage achieves a certain value for a certain amount of time. Moreover, the reference condition may include any combination of magnitude and duration limits.

When the voltage at the drain of the transistor 730 satisfies the reference condition, the driver 760 causes the drain current in the transistor 730 to decrease. The decrease in the drain current maintains the operating conditions of the transistor within the safe operating area thereby avoiding failure or degradation of the transistor 730.

As shown in FIG. 7, the operating area limiter 700 may include a signal processor 770. The signal processor 770 may be part of the detector 740 as shown in FIG. 7 or the signal processor 770 may be a separate component of the operating area limiter 700. The signal processor 770 may be any combination of digital or analog devices. The signal processor 770 may include latch and hold, de-bounce or de-glitch functions, noise reduction, and/or misfire detection. The purposes of the signal processor 770 include making sure the signal is proper, to tell subsequent devices how and when to react, and to determine reset conditions. For example, if the drain voltage of the transistor 730 fluctuates, intermittently satisfying the reference condition, the output of the detector 740 could also fluctuate. In this situation, the signal processing may include means to hold the output of the detector 740 at a set value.

The signal processor 770 may also keep the drain current at a set level until a reset condition is met, even if the drain voltage of the transistor returns to its design level or no longer satisfies the reference condition. The reset signal may result from central or local control in the system of which the operating area limiter is a part.

Additional advantages of the operating area limiter set/reset ability are that it allows detection and correction of the fault that caused the high drain voltage and it allows reinitiation of the system without damage to the transistor. For example, in the LED load 780 in FIG. 7, when the reference condition is met, the drain current in the transistor 730, and hence the LED current, is decreased thereby decreasing the light output of the LEDs 780. The system or a user could detect the reduced light output from the LEDs 780, correct the problem and then reset the operating area limiter 700. The drain current in the transistor 730 and the LED 780 current return to the design setting after reset.

Figure 8:
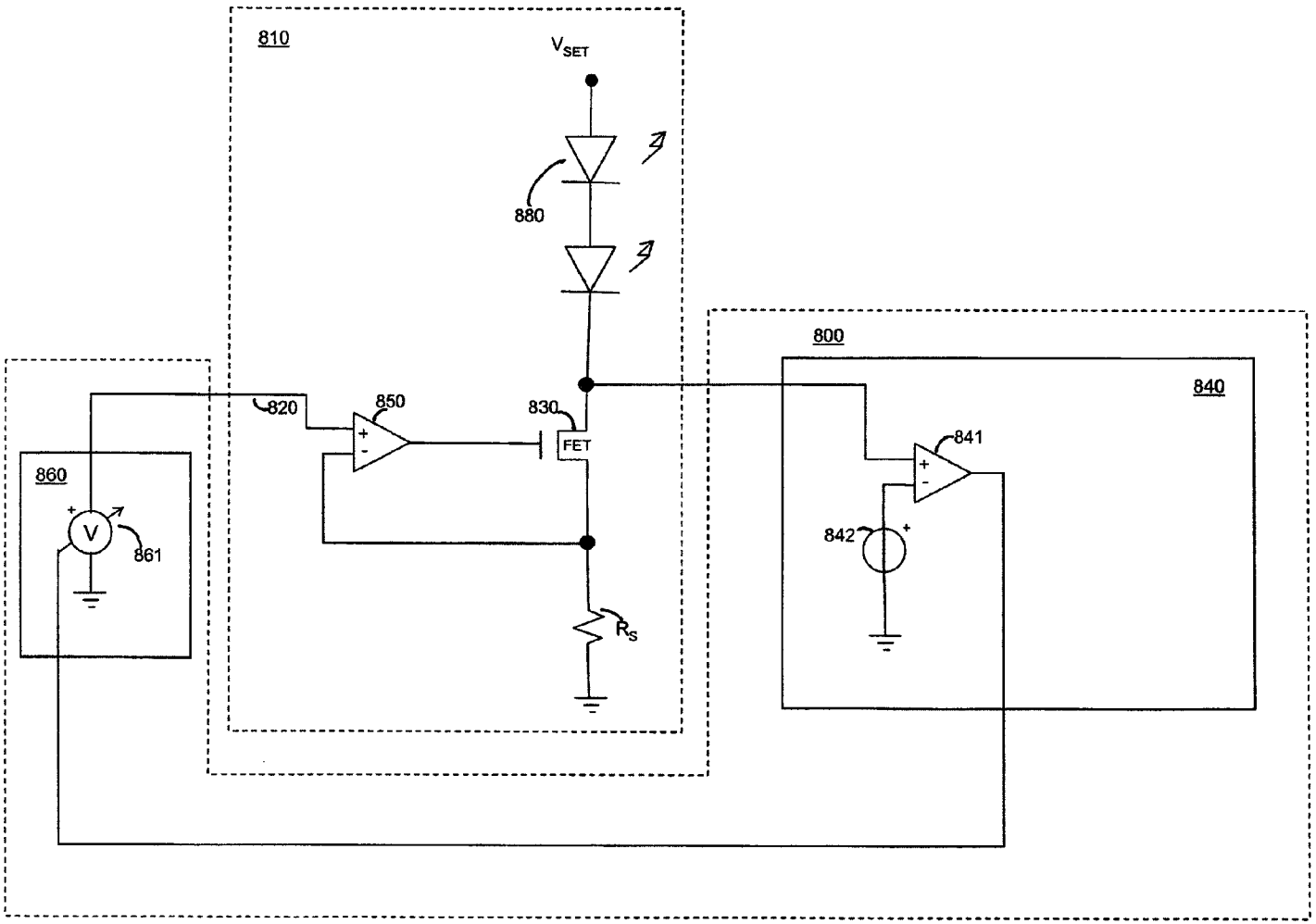
FIG. 8 illustrates an exemplary embodiment of the operating area limiter of the present invention.

As shown in FIG. 8, the detector 840 of the operating area limiter 800 may include a comparator 841. In FIG. 8, the voltage of the constant voltage source 842 is determined relative to the maximum safe drain-to-source voltage at the design drain current of the constant current source. The comparator 841 compares the voltage at the drain of the transistor 830 to the voltage of the constant voltage source 842. When the voltage at the drain of the transistor 830 exceeds a set value relative to the voltage of the constant voltage source, the output of the comparator 841 causes the driver 860 to decrease the drain current in the transistor 830. The decrease in the drain current maintains the operating conditions of the transistor within the safe operating area thereby avoiding degradation of the transistor 830.

The driver 760 of the operating area limiter 700 may cause the drain current of the transistor 730 to decrease by any of a number of possible means. As shown in FIG. 8, the driver 860 may decrease the drain current of the transistor 830 by decreasing the reference voltage 820 of the constant current source 810. The driver may include a variable voltage source 861 to reduce the reference voltage 820 of the constant current source 810. The reference voltage 820 of the constant current source 810 may be the non-inverting input of an operational amplifier 850 used in the constant current source 810.

Figure 9:
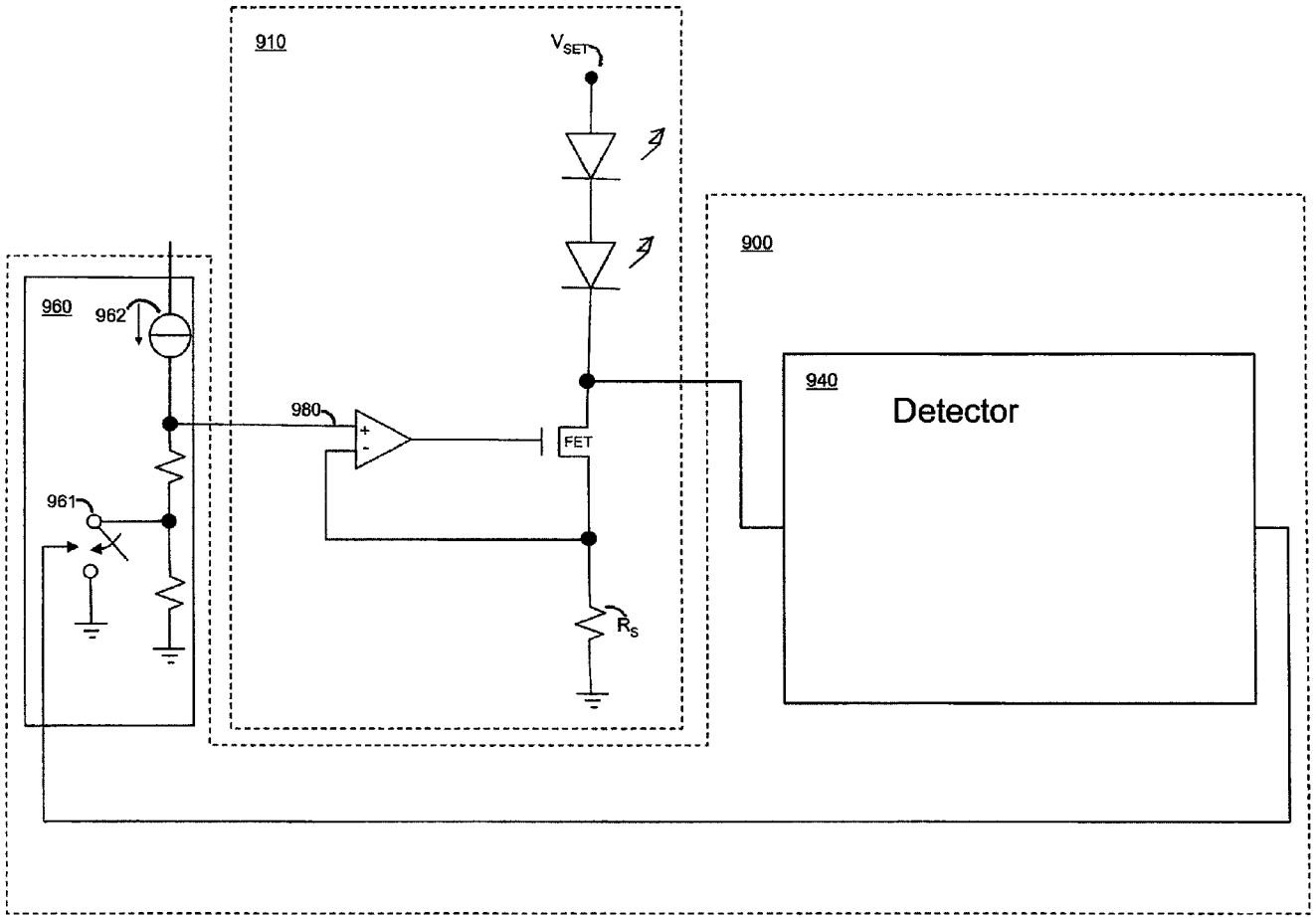
FIG. 9 illustrates an exemplary embodiment of the operating area limiter of the present invention.
Figure 10:
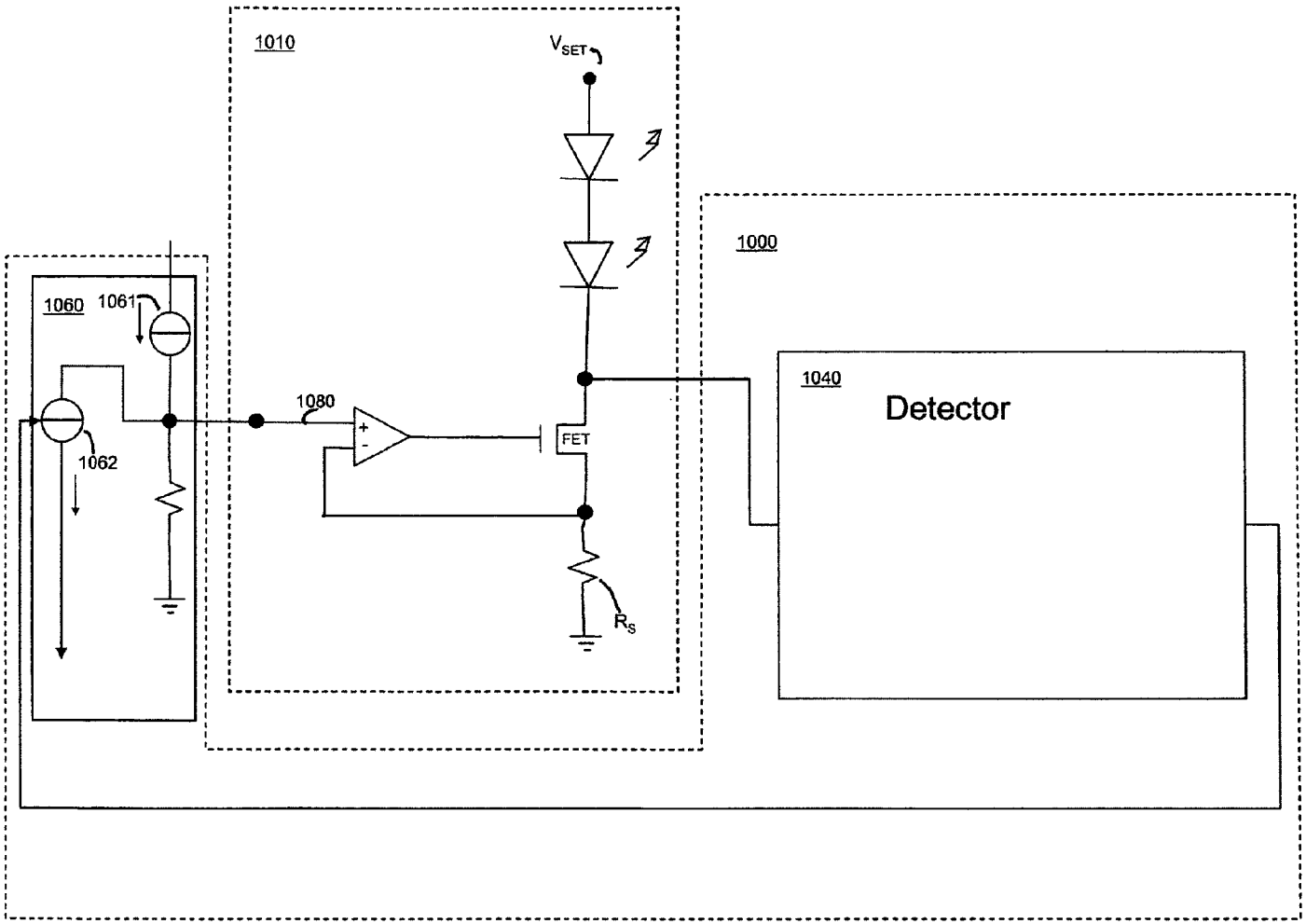
FIG. 10 illustrates an exemplary embodiment of the operating area limiter of the present invention.

Alternatively, as shown in FIG. 9, the driver 960 of the operating area limiter circuit 900 may include a switch 961 and a constant current source 962. When engaged, the switch 961 reduces the resistance of the current path form the constant current source 962 thereby reducing the reference voltage 980 of the constant current source 910. Another alternative method for reducing the reference voltage 980 is to use a potentiometer or variable resistor to control the resistance of the current path form the constant current source 962. In that case, the output of the detector 940 controls the resistance of the potentiometer thereby controlling the reference voltage 980. Alternatively, as shown in FIG. 10, the driver 1060 in the operating area limiter 1000 may include a current source 1062 that, when engaged, bleeds off current supplied by the current supply 1061 thereby reducing the reference voltage 1080 of the constant current source 1010. The detector 1040 controls the changes to the current source 1062 of the driver 1060.

Referring again to FIG. 7, the driver 760 may alternatively cause the drain current of the transistor 730 to decrease by increasing the resistance of the sensing resistor $R_S$. The sensing resistor $R_S$ may be a variable resistor or potentiometer with a resistance that changes in response to the output of the detector 740. The sensing resistor $R_S$ may also be implemented by multiple resistors some of which are only engaged based on the output of the detector 740. In FIG. 7, the sensing resistor $R_S$ is shown as part of the constant current source circuit 710. In implementations where the drain current of the transistor 730 is controlled by modifying the resistance of the sensing resistor $R_S$, the sensing resistor $R_S$ may also be a part of the operating area limiter circuit 700.

Figure 11:
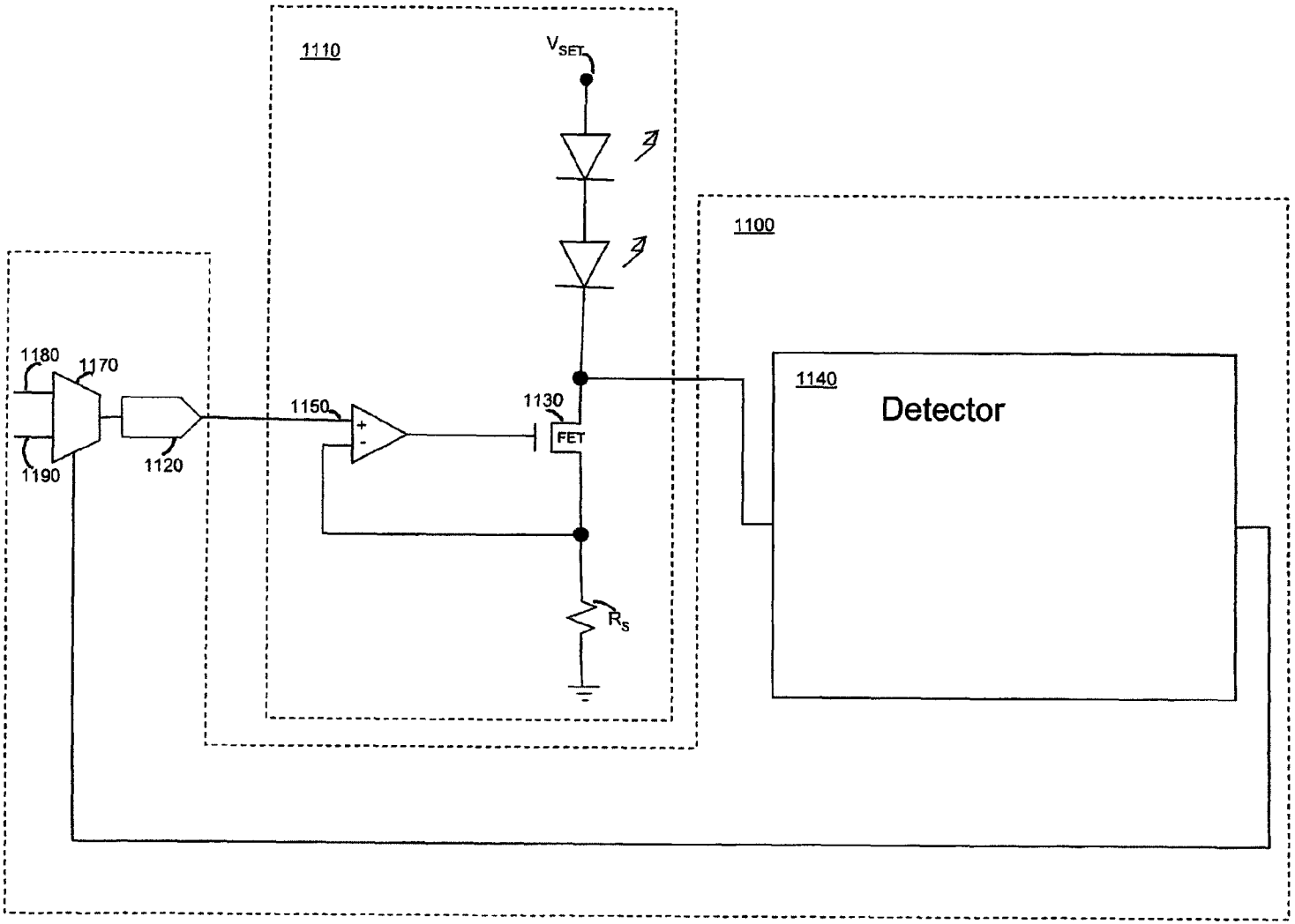
FIG. 11 illustrates an exemplary embodiment of the operating area limiter of the present invention.

The operating area limiter 700 of the present invention may be implemented using analog devices and circuits. Alternatively, the operating area limiter 1100 may be implemented using digital devices and circuits or a combination of analog and digital devices and circuits as shown in FIG. 11. In FIG. 11, the output of the detector 1140 controls a multiplexer 1170. The multiplexer 1170 has an input data bit for normal conditions 1180 and an input data bit for fault conditions 1190. At normal operating conditions, the multiplexer 1170 passes the input data bit for normal conditions 1180 to the digital-to-analog converter 1120. A fault condition occurs when the drain-to-source voltage of the transistor 1130 satisfies the reference condition of the detector 1140. In a fault condition, the multiplexer 1170 passes the input data bit for fault 5 conditions 1190 to a digital-to-analog converter 1120. When the fault bit 1190 is passed to the digital-to-analog converter 1120, the output of the converter 1120 is a reduced voltage, which reduces the reference voltage 1150 of the constant current source 1110.

Figure 12:
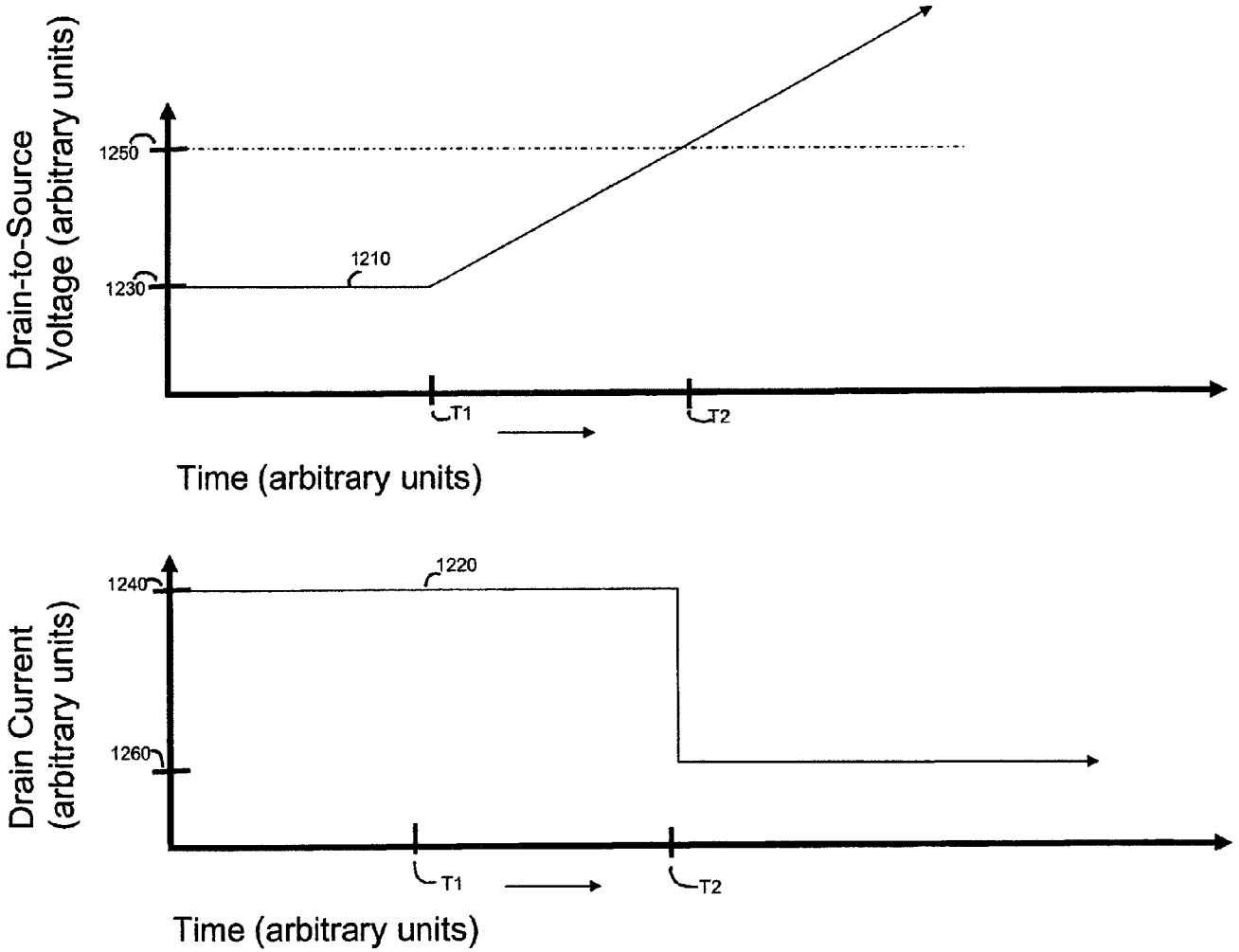
FIG. 12 illustrates the effect of an exemplary embodiment of the operating area limiter of the present invention on drain current of a transistor.

The effect of the exemplary operating area limiter 700 circuit of FIG. 7 is shown in FIG. 12. FIG. 12 shows the drain-to-source voltage 1210 and drain current 1220 of the transistor 730 as a function of time. Before time T1 the transistor 730 is operating at its design drain-to-source voltage 1230 and design drain current 1240. After time T1, the drain-to-source voltage 1210 increases. The increase may be due to an inadvertent short or other over-voltage condition as described previously. When the drain-to-source voltage 1210 satisfies the reference condition 1250 at time T2, the operating area limiter 700 causes the drain current of the constant current source 710 to be reduced to a level 1260 that will maintain the operating conditions of the transistor 730 within the safe operating area. The drain current may remain at the reduced level 1260 until there is a system or sub-system reset.

One of ordinary skill in the art will appreciate that the techniques, structures and methods of the present invention above are exemplary. The present inventions can be implemented in various embodiments without deviating from the scope of the invention.

The invention claimed is:

1. A circuit for limiting the operating area of a transistor in a constant current source, comprising:

a detector having a single input that is coupled to the constant current source, wherein the single input of the detector that is coupled to the constant current source is directly connected to the drain of the transistor included in the constant current source, the detector including an output; and a driver configured for controlling a drain current of the transistor included in the constant current source, wherein the driver has an input connected to the output of the detector and an output connected to the constant current source, the driver comprising a multiplexer and a digital-to-analog converter, wherein the detector and driver are configured such that when a voltage at the drain of the transistor included in the constant current source satisfies a reference condition, the driver causes the drain current of the transistor to decrease, the reference condition determined relative to a maximum safe drain-to-source voltage at a design drain current of the constant current source.

2. The circuit of claim 1, wherein the multiplexer includes a first input, a second input, a third input and an output, the first input configured for receiving information associated with a normal condition, the second input configured for receiving information associated with a fault condition, and the third input is coupled to the output of the detector.

3. The circuit of claim 2, wherein the digital-to-analog converter includes an input and an output, the input of the digital-to-analog converter coupled to the output of the multiplexer and the output of the digital-to-analog converter coupled to a reference voltage input of the constant current source.

4. The circuit of claim 3, wherein the multiplexer is configured such that when a voltage at the drain of the transistor fails to satisfy the reference condition, the multiplexer transmits the information associated with the normal condition received at its first input to the digital-to-analog converter.

5. The circuit of claim 3, wherein the multiplexer is configured such that when a voltage at the drain of the transistor satisfies the reference condition, the multiplexer passes the information associated with the fault condition received at its second input to the digital-to-analog controller, and wherein the digital-to-analog controller is configured to reduce a voltage at the output of the digital-to-analog controller upon receiving from the multiplexer the information associated with the fault condition.

6. The circuit of claim 5, wherein reducing the voltage at the output of the digital-to-analog controller reduces the reference voltage of the constant current source.

7. The circuit of claim 3, wherein the constant current source includes a comparator, the output of the digital-to-analog converter is coupled to a first input of the comparator that includes a second input and an output, the second input directly coupled to a source of the transistor in the constant current source and the output of the comparator is coupled to a gate of the transistor.

8. The circuit of claim 1, wherein the reference condition includes a duration limit such that the reference condition is not satisfied unless the voltage at the drain of the transistor achieves a certain value for a certain amount of time.

9. The circuit of claim 1, wherein the reference condition is based on a safe operating area of the transistor included in the constant current source.

10. The circuit of claim 1, wherein the detector comprises a signal processor.

11. The circuit of claim 10, wherein the signal processor includes at least one of latch and hold, de-bounce or de-glitch functions, noise reduction and misfire detection.

12. The circuit of claim 10, wherein the signal processor includes means to hold the output of the detector at a set value irrespective of fluctuations in the voltage at the drain of the transistor.

13. The circuit of claim 10, wherein the signal processor is configured for maintaining the drain current of the transistor, irrespective of the voltage at the drain of the transistor, until a reset signal is received by the signal processor.

14. The circuit of claim 1, wherein the driver is configured to decrease the drain current of the transistor by increasing the resistance of a sensing resistor included in the constant current source or the circuit.

15. The circuit of claim 14, wherein the sensing resistor is one of a variable resistor or a potentiometer with a resistance that is configurable based on the output of the detector.

16. The circuit of claim 14, wherein the sensing resistor includes a plurality of resistors, one or more of which are engaged based on the output of the detector.

17. The circuit of claim 1, wherein the circuit is configured for controlling the constant current source that is operable for providing a stable current to a light emitting diode (LED) array.

18. A method comprising:

determining a safe operating area of a transistor included in a constant current source;

configuring a detector for providing a set voltage based on determining the safe operating area of the transistor, the detector including an input that is coupled to an output of the constant current source;

detecting a voltage at a drain of the transistor;

determining whether the voltage at the drain of the transistor exceeds the set voltage;

responsive to determining that the voltage at the drain of the transistor exceeds the set voltage, controlling a driver comprising a multiplexer and a digital-to-analog converter for reducing a reference voltage provided by the driver to a comparator included in the constant current source, the driver coupled to an output of the detector; and based on reducing the reference voltage provided to the comparator, decreasing the drain current at the transistor and causing the transistor to operate in the safe operating area of the transistor, wherein the drain current of the transistor included in the constant current source is controlled by the comparator, with an input of the comparator directly coupled to a source of the transistor and an output of the comparator directly coupled to a gate of the transistor.

19. The method of claim 18, comprising:

responsive to determining that the voltage at the drain of the transistor exceeds the set voltage, controlling the driver for decreasing the drain current of the transistor by increasing the resistance of a sensing resistor included in the constant current source or the circuit.

20. The method of claim 18, wherein determining whether the voltage at the drain of the transistor exceeds the set voltage comprises:

determining whether the voltage at the drain of the transistor exceeds the set voltage for a specified time duration; and responsive to determining that the voltage at the drain of the transistor exceeds the set voltage for the specified time duration, controlling the driver for reducing the reference voltage provided to the comparator.

21. The method of claim 18, wherein controlling the driver for reducing the reference voltage provided by the driver to the comparator comprises:

configuring the multiplexer for transmitting information associated with a fault condition to the digital-to-analog controller when the voltage at the drain of the transistor exceeds the set voltage; and configuring the digital-to-analog controller for reducing a voltage at the output of the digital-to-analog controller upon receiving from the multiplexer the information associated with the fault condition.

22. The method of claim 21, wherein reducing the voltage at the output of the digital-to-analog controller reduces the reference voltage of the constant current source.

23. The method of claim 18, comprising:

providing a stable current to a light emitting diode (LED) array coupled to the constant current source.

* * * * *